United States Patent [19]

Bushell

[11] Patent Number: 4,502,618

[45] Date of Patent: Mar. 5, 1985

[54] CLOSURE DEVICE FOR CONTAINERS OF VOLATILE LIQUIDS

[76] Inventor: Hugh M. Bushell, Post Office, Wyandra, Australia, 4489

[21] Appl. No.: 342,928

[22] Filed: Jan. 26, 1982

[30] Foreign Application Priority Data

Feb. 2, 1981 [AU] Australia ..... PE7438

[51] Int. Cl.[3] ..... B65D 83/14

[52] U.S. Cl. ..... 222/396; 222/509; 251/61.1; 251/61.5

[58] Field of Search ..... 222/396, 397, 509, 399, 222/402.1, 549, 555; 251/61.1, 61.5, 110

[56] References Cited

U.S. PATENT DOCUMENTS

| | | | |
|---|---|---|---|
| 491,349 | 2/1893 | Hardoin | 222/549 X |
| 1,099,925 | 6/1914 | Kleinfeldt et al. | 222/399 |
| 2,427,441 | 9/1947 | Butts | 251/61.1 X |
| 2,459,527 | 1/1949 | Herbert | 251/61.1 |
| 3,851,796 | 12/1974 | Moos | 222/396 X |
| 4,094,332 | 6/1978 | Poff et al. | 251/61.1 X |

FOREIGN PATENT DOCUMENTS

| | | | |
|---|---|---|---|
| 320778 | 10/1929 | United Kingdom | 251/61.1 |

*Primary Examiner*—F. J. Bartuska
*Attorney, Agent, or Firm*—Maky, Renner, Otto & Boisselle

[57] ABSTRACT

This invention relates to a closure device for a container containing volatile liquid. The closure device is attachable to the container and includes a valve assembly having an actuating handle, a valve member associated with the actuating handle and a valve outlet. Preferably the valve assembly also includes a valve body which is attachable to a conduit projecting into the container and through which volatile liquid may be drawn upon operation of the valve assembly.

The invention also relates to an auxiliary valve for the container which comprises a valve body attachable to the container which includes a valve inlet for entry of fluid into the interior of the container and a relief valve or bypass passage for venting of excess fluid from the container to prevent build up of excess pressure within the interior of the container.

The invention also includes within its scope a container containing volatile liquid having the above mentioned closure device and auxiliary valve attached thereto.

12 Claims, 6 Drawing Figures

CLOSURE DEVICE FOR CONTAINERS OF VOLATILE LIQUIDS

This invention relates to a closure device which is particularly suited for continers which contain volatile liquids such as drums containing hydrocarbon fuels.

The widespread usage of motorcycles and small internal combustion engines used for farming, grazing and other agricultural or industrial applications necessitates the withdrawal of small amounts of fuel from drums on frequent occasions. Usually fuel drums are equipped with a pump which when actuated provides for the withdrawal of fuel when required. It is a common practice however to leave the pump attached to the fuel drum for convenience, however this practice has drawbacks in that it causes evaporation of the fuel to take place and also allow water ingress to occur if the drum is stored in a position which is open to the weather. It will of course be appreciated that fuel containing water will be injurious to small engines causing breakdown and malfunction, hence water ingress into fuel drums is a procedure to be avoided.

It will also be appreciated that unsealed fuel drums, which are prone to lose fuel by evaporation, will also add to atmospheric pollution and cause a fire hazard. This is especially the case with relatively large fuel drums (e.g. which contain 44 gallons of fuel or 200 liters).

With the above mentioned problems in mind, it has been a practice to dismantle the pump from the fuel drum which practice is time consuming and inefficient, or to store the fuel in small drums (e.g. containing 20 to 30 liters) which also is very inefficient and which also creates a fire hazard if the smaller drums are stored in a general workshop for example.

It is therefore an object of the invention to provide a closure device for containers which contain fuel or other volatile liquids which alleviates the above mentioned problems associated with the prior art.

The closure device of the invention is attachable to a container and especially to an aperture incorporated in the top wall thereof. However, this is not strictly necessary and the aperture may be included in a side wall thereof.

The closure device is suitably a valve assembly including actuating means, a valve member associated with the actuating means, and a valve outlet. There also is included a vlave body which suitably contains the valve member and which is suitably attached to a downwardly extending conduit which projects downwardly into the interior of the container and through which liquid fuel may be drawn upon operation of the valve assembly.

Preferably the outlet is an outlet port which is elongate and is in the form a a spout member extending from the valve body.

The valve body suitably includes a bore or interior passage which is substantially coaxial or co-extensive with the downwardly extending conduit referred to above. The valve member which is suitably a valve stem may be associated with biasing means such as a coil spring which may extend across or transversely to the bore of the valve body. However more preferably the valve stem may extend parallel to or coinciding with the longitudinal axis of the valve body. The valve member may also engage with a valve seat in the closed position which surround or is located adjacent to an inlet orifice of the outlet port.

The actuating means may be of any suitable type. A preferred form includes an actuating handle pivotally attached to the valve body and which handle is also pivotally attached to the valve member. In some cases the handle may be attached only to the valve member.

The valve assembly is suitably screw-threadedly attached to an associated aperture of the container and upon operation of the handle the valve stem may be drawn away from its associated valve seat and thus allow liquid to be drawn up the downwardly extending conduit and into the outlet port.

There also may be provided an auxiliary valve for attachment to an aperture of the container which is suitably larger or of greater diameter than the aperture to which is attached the above described valve assembly.

Suitably the auxiliary valve includes an air inlet to allow air to enter the container during night-time when the drum and its contents may cool after the heat of the daytime. This cooling action may cause contraction of the liquid fuel and concentration of vapour. This causes to regulate the internal pressure of the drum required for discharge of the liquid fuel during normal daytime operation.

The auxiliary valve may also have associated therewith a safety valve or bypass passage having a closure member which acts as a pressure relief device and which guards against the eventuality of excess pressure being present in the interior of the container.

Reference is now made to a preferred embodiment of the invention as shown in the attached drawings wherein.

Figure 2:
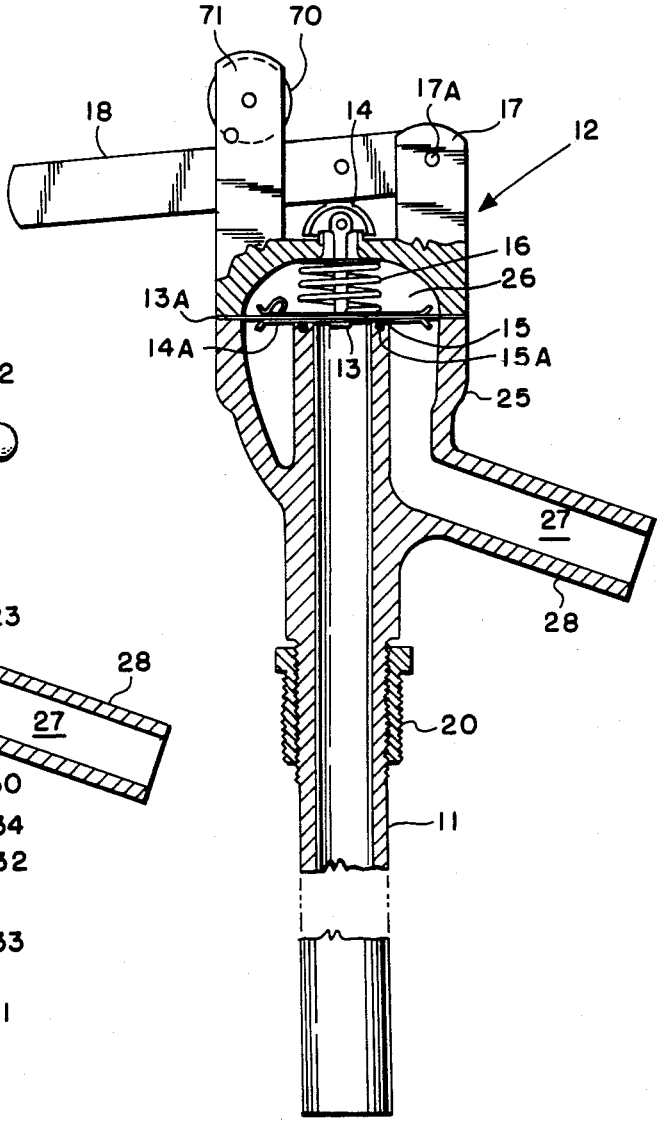
FIG. 2 is a cross sectional view of another type of closure device constructed in accordance with the invention.

Usually the container or oil drum 10 (which may contain 44 gallons or 200 liters of fuel) has a pressure developed within the interior thereof of approximately 5 pounds per square inch. Such pressure is retained by the wall closures and sealing devicess utilized as shown in the drawings.

This internal pressure forces the liquid fuel 9 up the tube 11 to valve assembly 12 wherein it is prevented from obtaining egress from the container 10 by the valve assembly 12 being in the closed position.

The valve assembly 12 includes valve stem 13, valve stem head 14, flexible diaphragm 13A interposed between upper and lower portions of the valve body 25, and metal retaining plates or stiffeners 14A for flexible diaphragm 13A. There is also shown valve seat 15 and O-ring 15A. Valve body 25 includes an internal chamber 26 communicating with tube 11. Valve body 25 also includes an outlet port in the form of a spout 28 having an outlet passage 27.

Figure 3:
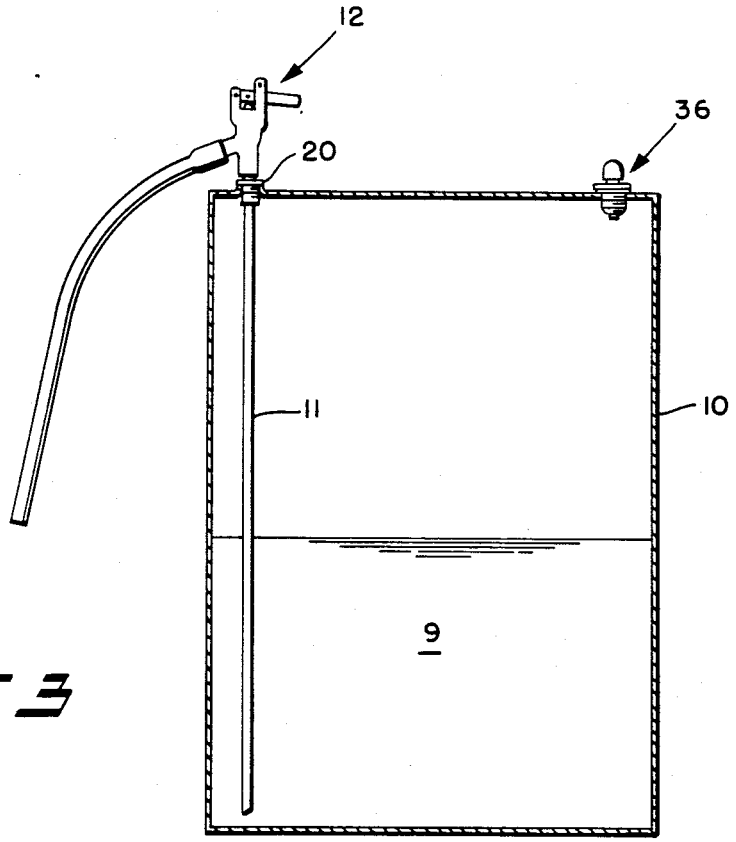
FIG. 3 is a view of the closure device of FIG. 2 attached to a fuel container.

Valve body 25 has upper extension 17 to which is pivotally attached an actuating handle or lever 18 which is pivotally attached to extension 17 at 17A. Valve stem head 14 is pivotally attached to lever 18 as shown and upward movement of lever 18 causes movement of stem 13 which elevates diaphragm 13A away from seat 15 against the bias of spring 16 to allow fluid to flow through passage 27 and from spout 28 from tube 11. Tube 11 screw threadedly locates in retaining cap 20 which locates in drum 10 as shown in FIG. 3. In the valve assembly shown in FIG. 1 handle 22 is contiguous until with valve stem 23 which is surrounded by spring 24. Valve stem 23 has base 29 which engages with seat 30 in the closed position. Tube 11 is screw threadedly attachable to valve body 31 at 32. Retaining washer 33 locates the valve assembly 12A with drum 10. Valve body 31 has passage 34 coaxial with tube 11 and chamber 35 for accommodating valve stem 23 and spring 24.

Figure 1:
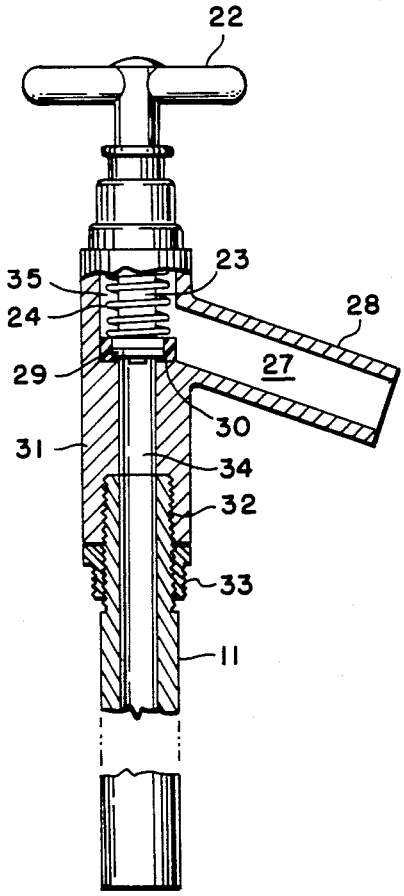
FIG. 1 is a cross sectional view of one type of closure device construced in accordance with the invention.

In operation of the valve assembly of FIG. 1 upward movement of handle 22 lifts valve stem base 29 of seat 30 thereby allowing fluid to pass from passage 34 into outlet passage 27 and exit through spout 28.

Figure 4:
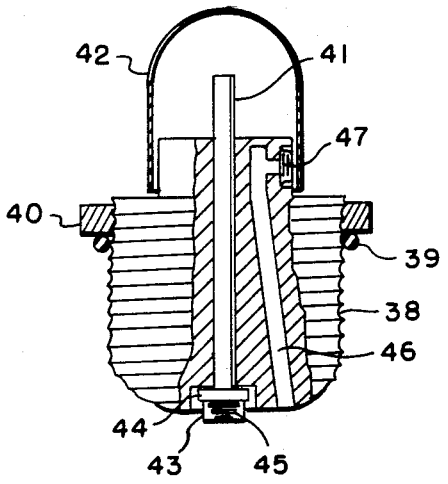
FIG. 4 is a view of one type of auxiliary valve contructed in accordance with the invention.

Auxiliary valve 36 includes valve body 38 which is screw-threaded as shown in FIG. 4, sealing ring 39, cap or head member 40 which may comprise a washer, air inlet tube 41, weather proof cap 42, valve 43 including abutment 44 mounted to spring 45, air bypass passage 46 and closure 47.

Figure 5:
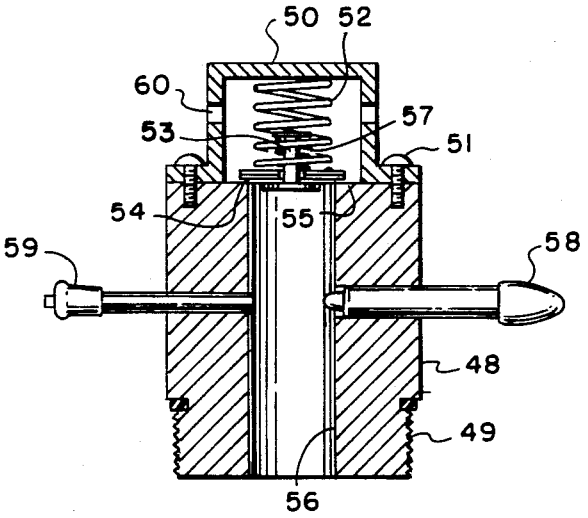
FIG. 5 is a view of another type of auxiliary valve constructed in accordance with the invention.

In FIG. 5 there is shown another type of auxiliary valve comprising valve body 48 for screw threaded attachment at 49 to drum 10, cap 50 bolted to valve body 48 by bolts 51, spring 52 surrounding valve stem 53, valve stem base 54 for engaging with valve seat 55 in the closed position, and valve body bore 56. There is also shown a smaller spring 57 surrounding valve stem 53 and pump connections 58 and 59 which may be of any suitable type (eg. similar to a vehicle tire valve).

Thus provision for pressuring the interior of drum 10 is provided by pump connections 58 and 59. Fluid may escape by lifting valve stem base 54 of seat 55 and thus allowing fluid to escape through outlets 60 in cap 50. This only requires a minimal pressure (eg. around 5.0 psi)

Figure 6:
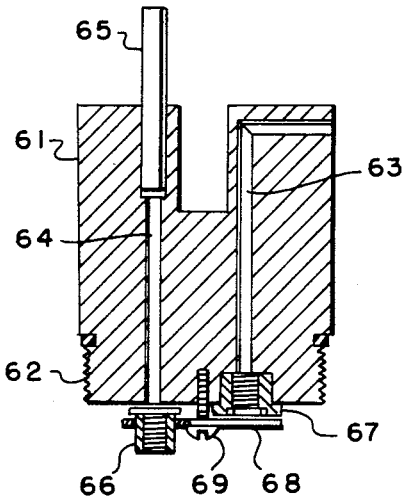
FIG. 6 is a view of another type of auxiliary valve constructed in accordance with the invention.

In FIG. 6 there is shown valve body 61 for screw threaded attachment at 62 to drum 10, interior passages 63 and 64, pump connection 65, fluid ingress valve 66 and fluid egress valve 67. Valves 66 and 67 are attached to valve body by retaining plate 68 by bolt 69. Valves 66 and 67 are similar to those described in FIGS. 4 and 5. Valve 66 allows fluid to enter the interior of drum 10 when required through passage 64 and valve 67 allows fluid to exit from container 10 when required through passage 63.

In FIG. 2 there is shown safety lock 70 attached to opposed brackets 71 to make the valve assembly 12 safe and childproof.

When the container 10 and liquid 9 cool during the night causing contraction of liquid and condensation of vapour, air is admitted through the various air entry mechanisms described above in relation to the auxiliary valves shown in FIGS. 4–6. The admission of air facilitates the attainment of internal pressure, required for normal daytime use as described above.

To augment the flow from discharge spout 28 in the case where repeated use has depleted the pressure in the drum 10 or if it is desired to withdraw liquid during the night or early morning a small bellow-type air pump such as is used to inflate air mattresses of inflatable toys can be connected to the auxiliary valves already described in FIGS. 4–6. To guard against the possible danger of misuse by a person applying excess pressure to the system and bursting the drum with subsequent disadvantages (eg. fire hazard, personal injury) a bypass passage or relief valve is included in the various auxiliary valves described above.

The materials preferred in the construction of the components of the invention are metal with neoprene sealing components. However, other materials may be used such as syntehtic plastics materials which are compatible with hydrocarbons and other volatile liquids.

I claim:

1. A closure device for a container containing volatile liquid and attachable to said container, said closure device including a valve assembly comprising:

a valve body;

a tubular valve seat contained within said valve body;

a valve chamber surrounding said tubular valve seat;

a discharge passage communicating with said valve chamber;

valve stem means associated with biasing means movable in said valve body between a valve closed position and a valve open position;

actuating means associated with said valve stem means for actuating movement thereof;

a sealing member retained within a groove in an upper horizontal surface of the valve seat;

a flexible diaphragm retained by the valve body and interposed between the horizontal upper surface of the valve seat and the biasing means and in contact with the sealing member in the closed position of the valve stem means, said flexible diaphragm including a deformable sheet interposed between an upper plate and bottom plate of rigid reinforcing material, the construction and arrangement being such that in the closed position the combination of said sealing member and said flexible diaphragm prevents access to the valve chamber from volatile material in the container and in the open position said volatile material is discharged through said discharge passage.

2. A closure device as set forth in claim 1, wherein said valve body is attachable to a conduit projecting into the container and through which volatile liquid may be drawn upon operation of the valve assembly.

3. A closure device as set forth in claim 2, wherein said valve body is screw threadedly attached to said conduit.

4. A closure device as set forth in claim 1, wherein said valve body is integral with a conduit projecting into the container and through which volatile liquid may be drawn upon operation of the valve assembly.

5. A closure device as set forth in claim 1, wherein said valve outlet includes an elongated spout member extending from said valve body.

6. A closure device as set forth in claim 1, wherein said actuating means is attached to said valve stem means and includes a handle pivotally attached to said valve body.

7. In combination, a container for volatile liquids, a closure device as set forth in claim 1 attached to said container, and an auxiliary valve including an auxiliary valve body attached to said container, said auxiliary valve body having a valve inlet for entry of air into the interior of said container and relief means for venting of air from said container to prevent build-up of excess pressure within the interior of said container.

8. A combination as set forth in claim 7, wherein said auxiliary valve further includes a pumping connection to facilitate build-up of pressure within the interior of said container when required.

9. In combination, a container for volatile liquids and a closure and liquid dispensing device attached to said container, said device comprising a valve assembly and conduit means extending into said container for conveying fluid to said valve assembly, said valve assembly including:

a valve body having a chamber, an inlet passage connecting said conduit means to said valve chamber at a tubular valve seat surrounded by said valve chamber, and a discharge passage communicating with said valve chamber;

an annular resilient sealing member retained within a groove in an annular end face of said valve seat;

valve means movable within said valve chamber between a closed position engaging said annular sealing member to prevent flow of volatile fluid into said valve chamber and an opened position clear of said annular sealing member to permit such flow and discharge of volatile fluid through said discharge passage, said valve means including a flexible diaphragm retained by said valve body at its periphery and interposed between upper and lower plates of relatively rigid material which serve to reinforce said flexible diaphragm in the operative area of said valve means to ensure against leakage of the fluid or vapors therefrom when abutting said resilient sealing member, and said discharge passage being open to the same side of said flexible diaphragm as said inlet passage;

a valve stem extending into said valve chamber for connection to said valve means;

means associated with said valve stem for biasing the same to a closed position closing said valve means; and actuating means for effecting movement of said valve stem to an open position opening said valve means to allow discharge of volatile fluid through said discharge passage, said actuating means including a lever arm which is pivotally mounted on said valve body and operative upon said valve stem to effect movement of said valve stem against the forced exerted by said means for biasing.

10. A combination as set forth in claim 9, wherein said discharge passage extends through an elongated spout member extending from said valve body.

11. A combination as set forth in claim 9, further comprising an auxiliary valve including an auxiliary valve body attached to said container, said auxiliary valve body having a valve inlet for entry of air into the interior of said container and relief means for venting of air from said container to prevent build-up of excess pressure within the interior of said container.

12. A combination as set forth in claim 11, wherein said auxiliary valve further includes a pumping connection to facilitate build-up of pressure within the interior of said container when required.

* * * * *